US009671749B2

(12) United States Patent
Sato

(10) Patent No.: US 9,671,749 B2
(45) Date of Patent: Jun. 6, 2017

(54) IMAGE FORMING APPARATUS INCLUDING CARTRIDGE AND URGING MEMBER

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/016,638

(22) Filed: Feb. 5, 2016

(65) Prior Publication Data

US 2016/0231701 A1 Aug. 11, 2016

(30) Foreign Application Priority Data

Feb. 6, 2015 (JP) ..... 2015-022595

(51) Int. Cl.
*G03G 15/00* (2006.01)
*G03G 21/18* (2006.01)

(52) U.S. Cl.
CPC ..... *G03G 21/1842* (2013.01)

(58) Field of Classification Search
USPC ..... 399/107, 110–114
See application file for complete search history.

(56) References Cited

U.S. PATENT DOCUMENTS 6,587,660 B2 7/2003 Ueno et al.
7,486,907 B2 2/2009 Noguchi et al.
7,660,549 B2 2/2010 Noguchi et al.
7,664,428 B2 2/2010 Kei
7,684,728 B2 3/2010 Okabe et al.
8,145,095 B2 3/2012 Sakurai et al.
8,358,952 B2 1/2013 Okabe
8,369,743 B2 * 2/2013 Maeshima ..... G03G 21/1825 399/111
8,452,208 B2 * 5/2013 Kikuchi ..... G03G 21/16 399/113
8,755,718 B2 * 6/2014 Ushiozu ..... G03G 15/04054 399/110

(Continued)

FOREIGN PATENT DOCUMENTS

JP H09-304994 A 11/1997
JP H11-344905 A 12/1999

(Continued)

OTHER PUBLICATIONS

Co-pending U.S. Appl. No. 15/016,581, filed Feb. 5, 2016.

(Continued)

*Primary Examiner* — Hoan Tran
(74) *Attorney, Agent, or Firm* — Banner & Witcoff, Ltd.

(57) ABSTRACT

An image forming apparatus includes a main body, a process cartridge, and a supporting frame. The process cartridge has a photosensitive drum defining a rotation axis extending in an axial direction, and an urging portion. The supporting frame is configured to support the process cartridge and be movable in a sliding direction between an inner position and an outer position of the main body. The urging portion is configured to exert urging force on the process cartridge in the state where the supporting frame supporting the process cartridge is in the inner position, such that the process cartridge is moved to the second position from the first position.

24 Claims, 11 Drawing Sheets

(56) References Cited

U.S. PATENT DOCUMENTS

| | | | | |
|---|---|---|---|---|
| 8,768,206 | B2 | 7/2014 | Sato | |
| 8,768,212 | B2 * | 7/2014 | Hashimoto | G03G 21/1821 399/111 |
| 8,792,805 | B2 | 7/2014 | Takayama | |
| 8,855,530 | B2 | 10/2014 | Sato | |
| 8,862,022 | B2 | 10/2014 | Sato et al. | |
| 8,892,002 | B2 | 11/2014 | Sato | |
| 8,929,770 | B2 | 1/2015 | Sato | |
| 9,037,036 | B2 | 5/2015 | Yamashita et al. | |
| 9,052,688 | B2 | 6/2015 | Sekido | |
| 9,134,686 | B2 | 9/2015 | Yoshikawa et al. | |
| 9,134,695 | B2 | 9/2015 | Furukawa et al. | |
| 9,146,492 | B2 | 9/2015 | Suzuki | |
| 2007/0077087 | A1 | 4/2007 | Okabe et al. | |
| 2007/0160385 | A1 | 7/2007 | Noguchi et al. | |
| 2009/0047039 | A1 | 2/2009 | Noguchi et al. | |
| 2009/0092412 | A1 | 4/2009 | Kei | |
| 2009/0324275 | A1 | 12/2009 | Okabe | |
| 2010/0080619 | A1 | 4/2010 | Kawanami | |
| 2010/0124432 | A1 * | 5/2010 | Takayama | G03G 21/1853 399/110 |
| 2010/0239314 | A1 | 9/2010 | Takayama | |
| 2012/0057900 | A1 | 3/2012 | Okabe | |
| 2012/0114374 | A1 | 5/2012 | Suzuki | |
| 2012/0195627 | A1 * | 8/2012 | Kikuchi | G03G 21/1647 399/110 |
| 2012/0328325 | A1 | 12/2012 | Sato | |
| 2012/0328326 | A1 | 12/2012 | Sato | |
| 2012/0328327 | A1 | 12/2012 | Sato | |
| 2013/0108316 | A1 | 5/2013 | Sato et al. | |
| 2013/0308976 | A1 | 11/2013 | Sekido | |
| 2013/0315619 | A1 | 11/2013 | Shuhama et al. | |
| 2014/0064782 | A1 | 3/2014 | Furukawa et al. | |
| 2014/0137372 | A1 | 5/2014 | Yamashita et al. | |
| 2014/0147158 | A1 | 5/2014 | Fujinaka et al. | |
| 2014/0186082 | A1 | 7/2014 | Yoshikawa et al. | |
| 2014/0210929 | A1 | 7/2014 | Suzuki | |
| 2014/0314446 | A1 | 10/2014 | Sato | |
| 2015/0010325 | A1 | 1/2015 | Sato et al. | |
| 2015/0023691 | A1 | 1/2015 | Sato | |
| 2015/0071681 | A1 | 3/2015 | Sato | |
| 2015/0110523 | A1 | 4/2015 | Sato | |
| 2015/0227110 | A1 | 8/2015 | Yoshimura et al. | |
| 2016/0026151 | A1 | 1/2016 | Sato et al. | |

FOREIGN PATENT DOCUMENTS

| | | | |
|---|---|---|---|
| JP | 2001-337580 | A | 12/2001 |
| JP | 2004-177443 | A | 6/2004 |
| JP | 2007-101635 | A | 4/2007 |
| JP | 2009-092914 | | 4/2009 |
| JP | 2010-008724 | A | 1/2010 |
| JP | 2010-117731 | A | 5/2010 |
| JP | 2010-217813 | A | 9/2010 |
| JP | 2011-059730 | A | 3/2011 |
| JP | 2011-070142 | A | 4/2011 |
| JP | 2013-007946 | A | 1/2013 |
| JP | 2013-007947 | A | 1/2013 |
| JP | 2013-007948 | A | 1/2013 |
| JP | 2013-097185 | A | 5/2013 |
| JP | 2013-242439 | A | 12/2013 |
| JP | 2013-246366 | A | 12/2013 |
| JP | 2014-067005 | A | 4/2014 |
| JP | 2014-067010 | A | 4/2014 |
| JP | 2014-106392 | A | 6/2014 |
| JP | 2014-106393 | A | 6/2014 |
| JP | 2014-123107 | A | 7/2014 |
| JP | 2014-126842 | A | 7/2014 |
| WO | 2014038725 | A1 | 3/2014 |

OTHER PUBLICATIONS

Co-pending U.S. Appl. No. 15/016,616, filed Feb. 5, 2016.
Co-pending U.S. Appl. No. 15/016,646, filed Feb. 5, 2016.
Co-pending U.S. Apl. No. 15/015,788, filed Feb. 4, 2016.
Co-pending U.S. Appl. No. 15/015,323, filed Feb. 4, 2016.
Co-pending U.S. Appl. No. 15/014,137, filed Feb. 3, 2016.
Jun. 6, 2016—(US) Notice of Allowance—U.S. Appl. No. 15/016,581.
Jun. 17, 2016—(US) Non-Final Office Action—U.S. Appl. No. 15/016,616.
May 19, 2016—(US) Non-Final Office Action—U.S. Appl. No. 15/014,137.

* cited by examiner

IMAGE FORMING APPARATUS INCLUDING CARTRIDGE AND URGING MEMBER

CROSS REFERENCE TO RELATED APPLICATION

This application claims priority from Japanese Patent Application No. 2015-022595 filed Feb. 6, 2015. The entire content of the priority application is incorporated herein by reference.

TECHNICAL FIELD

The present disclosure relates to an electro-photographic type image forming apparatus.

BACKGROUND

A conventional electro-photographic type image forming apparatus includes a main housing and an image carrier configured to carry a developing agent image.

Among the various conventional image forming apparatuses in the art, there is an image forming apparatus including a main housing, a photosensitive drum, a plurality of cartridges attachable to and detachable from the main housing, and a tray movable between an inside and outside of the main housing. Specifically, the tray is provided with an urging member for urging the cartridge in a direction away from a belt.

SUMMARY

However, unlike the cartridge, the tray is not exchanged by a new tray on a regular basis. Therefore, routine inspection and maintenance to the tray may not be performed. As a result, breakdown of the urging member may occur.

It is therefore an object of an embodiment of the disclosure to provide an image forming apparatus provided with a re-conveying unit capable of restraining damage to the urging member that urges a process cartridge.

It is therefore an object of the disclosure (in particular a first embodiment described herein) to provide an image forming apparatus capable of restraining damage to the urging member that urges a process cartridge.

According to one aspect, an image forming apparatus includes a main body, a process cartridge, and a support frame. The main body has a positioning portion. The process cartridge includes a photosensitive drum defining a rotation axis extending in an axial direction and an urging portion. The supporting frame is configured to support the process cartridge and movable in a sliding direction perpendicular to the axial direction between an inner position inside the main body and an outer position outside the main body. The process cartridge is movable between a first position and a second position in a state where the supporting frame supporting the process cartridge is in the inner position. The photosensitive drum and the positioning portion engage with each other in the first position. The engagement between the photosensitive drum and the positioning portion are released in the second position. The urging portion is configured to exert urging force on the process cartridge in the state where the supporting frame supporting the process cartridge is in the inner position, such that the process cartridge is moved to the second position from the first position.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1:
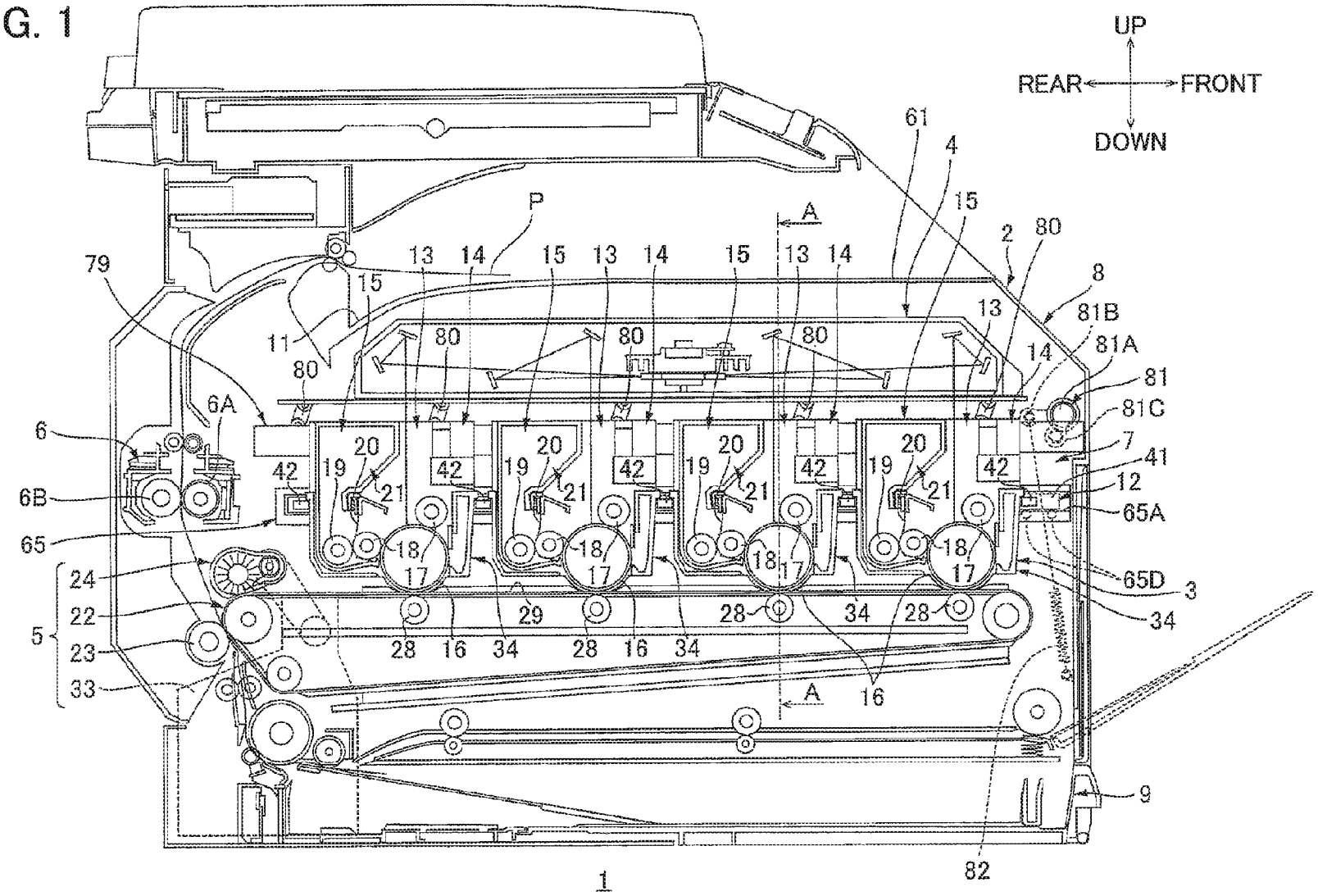
FIG. 1 is a cross-sectional view of a printer as an example of an image forming apparatus according to one embodiment.

As illustrated in FIG. 1, a printer 1 according to one embodiment will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that the printer 1 is disposed in an orientation in which it is intended to be used. In use, the printer 1 is disposed as shown in FIG. 1.

The printer 1 includes an apparatus body 2 which includes four process cartridges 13. Each of the four process cartridges 13 includes a photosensitive drum 16, a support frame 12 which supports four process cartridges 13, a scanner unit 4 which forms an electrostatic latent image on the photosensitive drum 16, a transfer unit 5 which transfers a toner image on the photosensitive drum 16 onto a sheet P, and a fixing unit 6 which fixes the toner image on the sheet P onto the sheet P.

The apparatus body 2 has a substantially box shape. The apparatus body 2 has an opening 7 which is formed at the front end portion of the apparatus body 2 so that the inside and the outside of the apparatus body 2 communicate with each other in the frontward/rearward direction (a slide direction). The opening 7 allows the support frame 12 to pass therethrough.

The apparatus body 2 includes a front cover 8 which opens and closes the opening 7, a sheet feeding tray 9 which stores the sheet P, and a sheet discharging tray 11 which accommodates the sheet P having the toner image fixed thereto. The front cover 8 is disposed at the front end of the apparatus body 2 so as to close the opening 7. The front cover 8 has a substantially flat plate shape which extends in the upward/downward direction (the orthogonal direction). The front cover 8 is adapted to swing about the lower end as a support point between a closing position (see FIG. 1) where the opening 7 is closed and an opening position (see FIG. 9) where the front cover is inclined forward from the closing position so as to open the opening 7. The front cover 8 is an example of a cover.

The sheet feeding tray 9 is disposed at the bottom portion of the apparatus body 2. The sheet feeding tray 9 is configured to store the sheet P. The sheet P inside the sheet feeding tray 9 is fed one by one between an intermediate transfer belt 29 and a secondary transfer roller 23 to be described later at a predetermined timing upon rotations of other rollers.

The sheet discharging tray 11 is disposed at the upper end portion of the apparatus body 2. The sheet discharging tray 11 is recessed downward from the upper surface of the apparatus body 2.

Although it will be described below, the support frame 12 has a substantially frame shape extending in the frontward/rearward direction. The support frame 12 supports a substantially center portion of the process cartridge 13 in the upward/downward direction.

Four process cartridges 13 are disposed so as to be separated from one another in the frontward/rearward direction. Each process cartridge 13 includes a drum unit 14 and a developing unit 15.

The drum unit 14 includes the photosensitive drum 16, a charging roller 17 which charges the surface of the photosensitive drum 16, and a drum cleaner 34 which cleans the surface of the photosensitive drum 16.

The developing unit 15 includes a developing roller 18 which supplies a toner to the photosensitive drum 16 so as to develop an electrostatic latent image on the surface of the photosensitive drum 16, a supply roller 19 which supplies a toner to the developing roller 18, a toner thickness regulation blade 20 which regulates the thickness of the toner carried by the developing roller 18 at a predetermined layer thickness, and a toner storage portion 21 which stores a toner.

The scanner unit 4 is disposed upward of the support frame 12 at the upper end portion of the apparatus body 2. The scanner unit 4 forms an electrostatic latent image on the surface of the photosensitive drum 16 based on image data by exposing the surface of the photosensitive drum 16 charged by the charging roller 17.

The transfer unit 5 includes an intermediate transfer belt 29, primary transfer rollers 28 which transfer the toner image on the surface of the photosensitive drum 16 onto the intermediate transfer belt 29, a secondary transfer roller 23 which transfers the toner image on the surface of the intermediate transfer belt 29 onto the sheet P, a belt cleaner 24 which cleans the surface of the intermediate transfer belt 29, and a toner waste storage portion 33 which stores a residual toner or paper dust cleaned by the belt cleaner 24. The intermediate transfer belt 29 and the primary transfer rollers 28 are disposed downward of the support frame 12. The secondary transfer roller 23 is disposed rearward of the belt unit 22 and contacts the intermediate transfer belt 29. The belt cleaner 24 is disposed upward of the rear end portion of the belt unit 22. The toner waste storage portion 33 is disposed at the lower end portion of the apparatus body 2.

The fixing unit 6 is disposed upward of the secondary transfer roller 23. The fixing unit 6 includes a heating roller 6A and a pressing roller 6B which presses in contact with the rear end of the heating roller 6A. The heating roller 6A and the pressing roller 6B are configured to thermally fix the toner image onto the sheet P.

2. Support Frame

Figure 3:
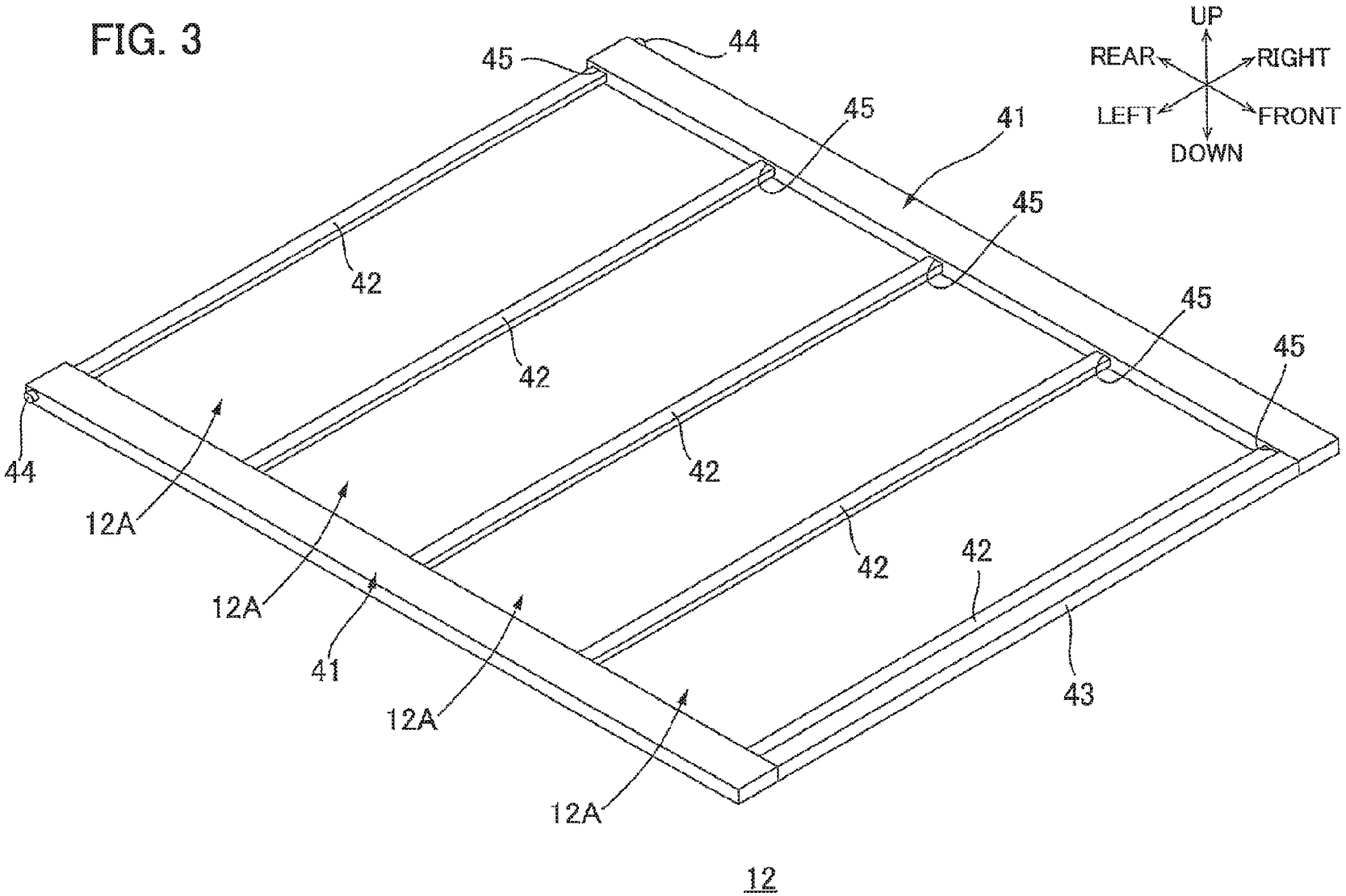
FIG. 3 is a perspective view of a support frame as viewed from front upper side thereof in the printer according to the embodiment.

The support frame 12 has, as illustrated in FIG. 3, a substantially rectangular shape in the top view. The support frame 12 is adapted to move horizontally in the frontward/rearward direction (the slide direction) between an inner position (see FIG. 1) located inside the apparatus body 2 and an outer position (see FIG. 11) outside the apparatus body through the opening 7. The support frame 12 includes a first target guide portion 41L, a second target guide portion 41R, five beam members 42, a front beam 43, and two rollers 44.

The first target guide portion 41L is disposed at the left end portion of the support frame 12. The left end portion of the support frame 12 is an example of a first end. Further, the second target guide portion 41R is disposed at the right end portion of the support frame 12. The right end of the support frame 12 is an example of a second end. Each of the first target guide portion 41L and the second target guide portion 41R has a substantially bar shape extending in the frontward/rearward direction. More specifically, the target guide portion has a substantially prismatic shape. Further, the first target guide portion 41L and the second target guide portion 41R are disposed at the same vertical position. The first target guide portion 41L is fitted into a first guide groove 65A of a left guide portion 65 to be described later. When the support frame 12 moves, the first target guide portion 41L is guided by of the left guide portion 65. Further, the second target guide portion 41R is fitted into the first guide groove 65A of a right guide portion 65 to be described later. When the support frame 12 moves, the second target guide portion 41R is guided by the right guide portion 65. The second target guide portion 41R forms five fitting holes 45. Five fitting holes 45 are formed from the front end to the rear end of the second target guide portion 41R so as to be separated from one another in the frontward/rearward direction. The fitting holes 45 are recessed rightward from the left surface of the second target guide portion 41R. The fitting hole 45 has a substantially rectangular shape in the side view. In addition, the first target guide portion 41L also includes five fitting holes similarly to the second target guide portion 41R. The first target guide portion 41L and second target guide portion 41R are examples of a first guided member and a second guided member, respectively.

Five beam members 42 are disposed between the first target guide portion 41L and the second target guide portion 41R so as to be separated from one another at the same interval in the frontward/rearward direction. The beam member 42 has a substantially bar shape extending in the leftward/rightward direction. More specifically, the beam member has a substantially prismatic shape. The right end of the beam member 42 is fitted to the corresponding fitting hole 45 on the second target guide portion 41R. The left end of the beam member 42 is fitted to the corresponding fitting hole 45 on the first target guide portion 41L. Accordingly, a space between the first target guide portion 41L and the second target guide portion 41R is divided into four parts in the frontward/rearward direction. In other words, four openings 12A are defined between the first target guide portion 41L and the second target guide portion 41R.

The front beam 43 is disposed between the front end portion of the first target guide portion 41L and the front end portion of the second target guide portion 41R frontward of the foremost beam member 42. The front beam 43 has a substantially prismatic shape extending in the leftward/rightward direction. The left end of the front beam 43 is continuous to the front end portion of the first target guide portion 41L. Further, the right end portion of the front beam 43 is continuous to the front end portion of the second target guide portion 41R.

Figure 2:
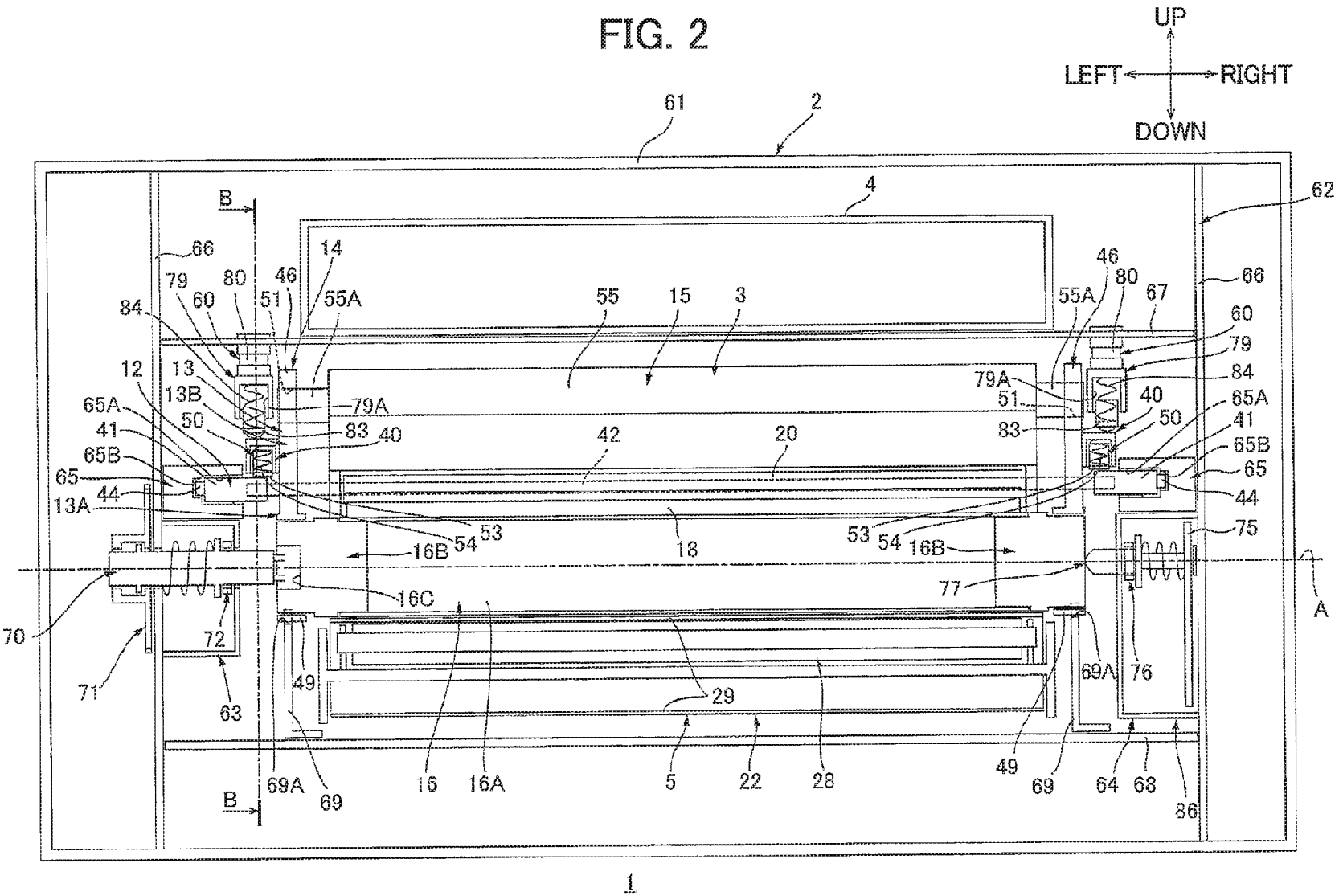
FIG. 2 is a cross-sectional view taken along a line A-A of FIG. 1.

The two rollers 44 include a left roller 44 and a right roller 44. The left roller 44 is rotatably supported by the left surface of the rear end portion of the first target guide portion 41L. Further, the right roller 44 is rotatably supported by the right surface of the rear end of the second target guide portion 41R. Each roller 44 has a substantially disk shape having a thickness in the leftward/rightward direction. As illustrated in FIG. 2, the left roller 44 is fitted into a second guide groove 65B formed on the left guide portion 65. Further, the right roller 44 is fitted into a second guide groove 65B formed on the right guide portion 65.

3. Process Cartridge

The following describes one of the four process cartridges 13 in a state where the support frame 12 is positioned at the inner position while supporting four (the plurality of) process cartridges 13. Incidentally, four (the plurality of) process cartridges 13 have the same configuration except for the colors of the toner stored therein. The process cartridge 13 has a substantially prismatic shape extending in the leftward/rightward direction as illustrated in FIGS. 1 and 2. The process cartridge 13 is vertically inserted into the apparatus body 2 through the opening 12A formed on the support frame 12, so that the photosensitive drum 16 is disposed downward of the support frame 12.

That is, the process cartridge 13 is disposed between the first target guide portion 41L and the second target guide portion 41R in the leftward/rightward direction, and is disposed between two of the beam members 42 in the frontward/rearward direction. Further, a lower portion 13A of the process cartridge 13 is disposed below the support frame 12, and an upper portion 13B is disposed above the support frame 12. When viewed in the leftward/rightward direction, the lower and upper portions 13A and 13B are exposed from the support frame 12.

Further, the process cartridge 13 is movable between a first position (see FIG. 2) in which the photosensitive drum 16 contacts the intermediate transfer belt 29 and a second position (see FIG. 10) in which the photosensitive drum 16 is separated from the intermediate transfer belt 29.

As described above, the process cartridge 13 includes the drum unit 14 and the developing unit 15.

(1) Drum Unit

Figure 6:
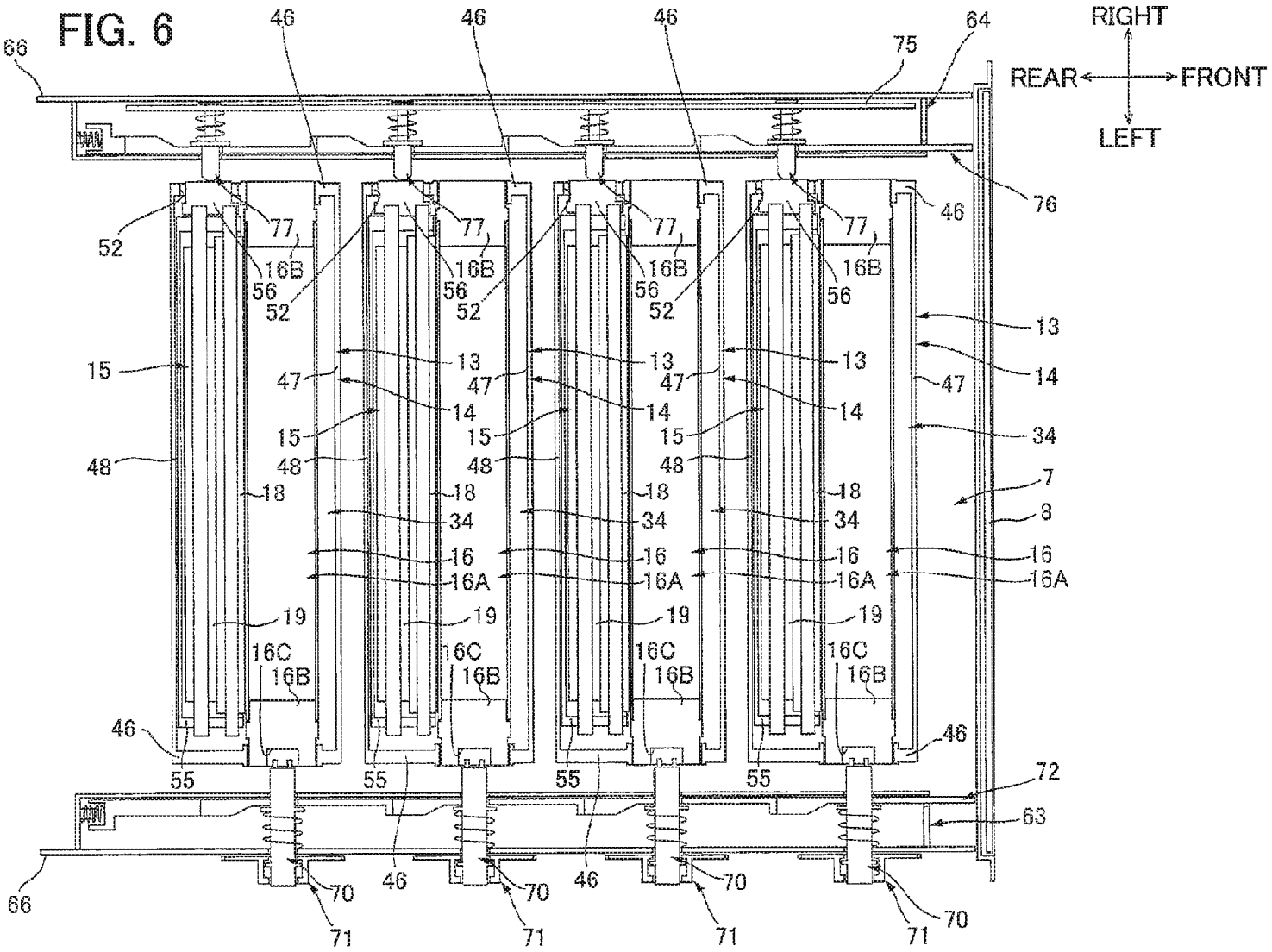
FIG. 6 is a cross-sectional view of the printer taken along a line C-C of FIG. 5.

As illustrated in FIGS. 2 and 6, the drum unit 14 has a substantially box shape forming an open upper end. The drum unit 14 further includes two side walls 46, a front wall 47, and a rear wall 48.

Figure 4A:
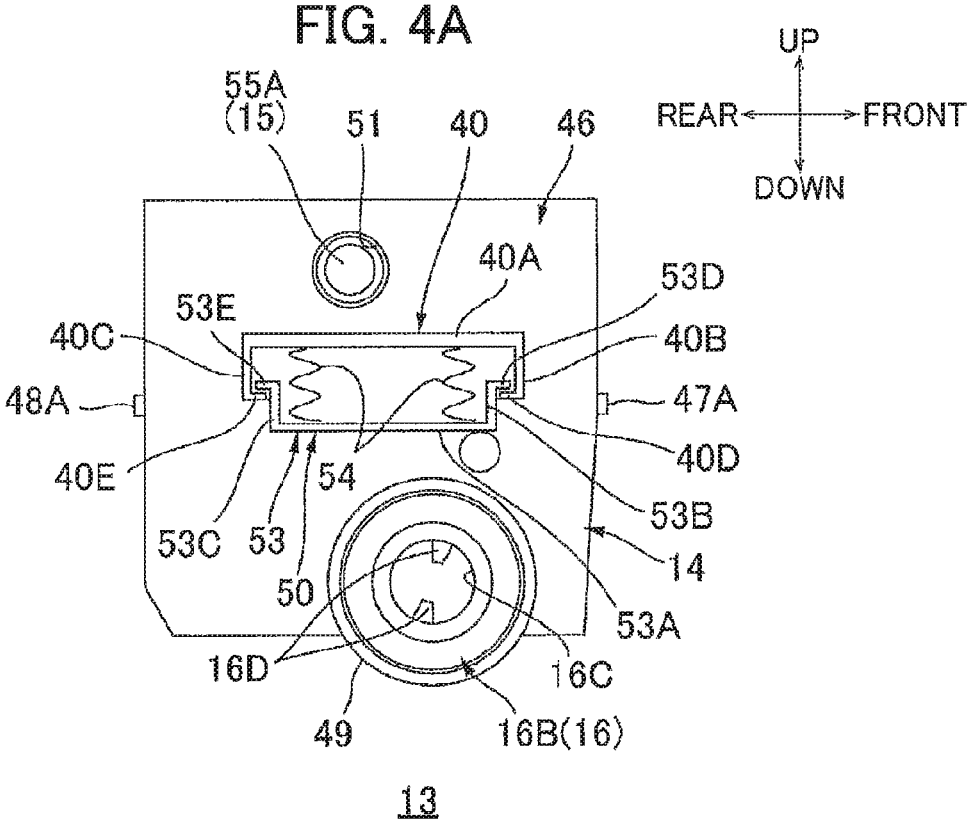
FIG. 4A is a left side view of a process cartridge in the printer according to the embodiment.
Figure 4B:
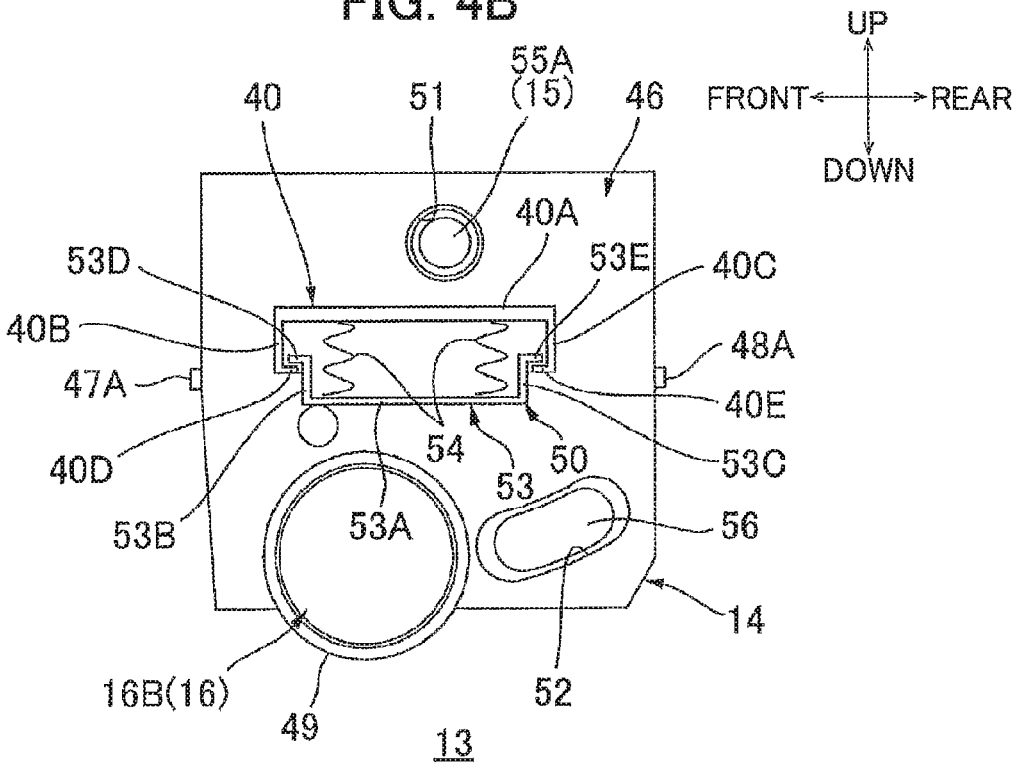
FIG. 4B is a right side view of the process cartridge in the printer according to the embodiment.

As illustrated in FIGS. 2 and 4A, the side walls 46 include a left side wall 46 and a right side wall 46. The left side wall 46 is disposed at the left end portion of the drum unit 14. Further, as illustrated in FIGS. 2 and 4B, the right side wall 46 is disposed at the right end portion of the drum unit 14. The side wall 46 has a flat-plate shape forming a substantially rectangular shape in the side view. The side wall 46 includes a drum support portion 49 which supports the photosensitive drum 16 and a developing support portion 51 which supports the developing unit 15. The drum support portion 49 is disposed at slightly front side with respect to the center of the lower end portion of the side walls 46 in the frontward/rearward direction. The drum support portion 49 has a substantially cylindrical shape extending in the leftward/rightward direction and penetrates the side walls 46 in the leftward/rightward direction. The developing support portion 51 is disposed at the substantially center of the upper end portion of the side walls 46 in the frontward/rearward direction. The developing support portion 51 has a substantially circular shape in the side view and penetrates the side walls 46 in the leftward/rightward direction. The right side wall 46 includes an exposure opening 52 for exposing a developing electrode 56 to be described later. The exposure opening 52 is formed to penetrate the right side wall 46 in the leftward/rightward direction, and is disposed at the lower end portion of the right side wall 46 and rearward of the drum support portion 49. The exposure opening 52 extends upward and rearward so as to be curved in a substantially circular-arc shape about the developing support portion 51 in the side view.

As illustrated in FIGS. 1 and 6, the front wall 47 is disposed between the front end portion of the left side wall 46 and the front end of the right side wall 46. The left end portion of the front wall 47 is connected to the front end portion of the left side wall 46. Further, the right end portion of the front wall 47 is connected to the front end portion of the right side wall 46. As illustrated in FIG. 4A, the front wall 47 includes an engagement rib 47A which engages with the support frame 12. The engagement rib 47A is disposed at the substantially center of the front wall 47 in the upward/downward direction. The engagement rib 47A protrudes forward from the front surface of the front wall 47 and has a substantially flat plate shape extending in the leftward/rightward direction. The engagement rib 47A contacts the upper surface of the rear end portion of the beam member 42 that is positioned frontward of the front wall 47.

As illustrated in FIGS. 1 and 6, the rear wall 48 is disposed between the rear end portion of the left side wall 46 and the rear end portion of the right side wall 46. The rear wall 48 has a substantially flat plate shape extending in the leftward/rightward direction. The left end portion of the rear wall 48 is connected to the rear end portion of the left side wall 46. Further, the right end portion of the rear wall 48 is connected to the rear end portion of the right side wall 46. The rear wall 48 includes, as illustrated in FIG. 4A, an engagement rib 48A which engages with the support frame 12. The engagement rib 48A is disposed at the substantially center of the rear wall 48 in the upward/downward direction. The engagement rib 48A protrudes backward from the rear surface of the rear wall 48 and has a substantially flat plate shape extending in the leftward/rightward direction. The engagement rib 48A contacts the upper surface of the front end portion of the beam member 42 that is positioned rearward of the rear wall 48.

As illustrated in FIGS. 2, 4A, and 4B, the drum unit 14 further includes two protrusion portions 40 and two urging portions 50 which urge the support frame 12.

The two protrusion portions 40 have a left protrusion portion 40 and a right protrusion portion 40. The left protrusion portion 40 protrudes outward from the outer surface of the left side wall 46 in the leftward/rightward direction. Further, the right protrusion portion 40 protrudes outward from the outer surface of the right side wall 46 in the leftward/rightward direction. The protrusion portion 40 has a substantially box shape extending in the frontward/rearward direction. The left protrusion portion 40 overlaps the first target guide portion 41L of the support frame 12 when viewed in the upward/downward direction. Further, the right protrusion portion 40 overlaps the second target guide portion 41R of the support frame 12 when viewed in the upward/downward direction. Each protrusion portion 40 includes an upper wall 40A which extends in the frontward/rearward direction, a front wall 40B which extends downward from the front end portion of the upper wall 40A, a rear wall 40C which extends downward from the rear end portion of the upper wall 40A, an engagement portion 40D which extends backward from the lower end portion of the front wall 40B, and an engagement portion 40E which extends forward from the lower end of the rear wall 40C. The engagement portion 40D and the engagement portion 40E are disposed so as to be separated from each other in the frontward/rearward direction. Incidentally, the upper wall 40A is an example of a first protrusion wall of the protrusion portion 40. The front wall 40B is an example of a second protrusion wall of the protrusion portion 40. The rear wall 40C is an example of a third protrusion wall of the protrusion portion 40. The engagement portion 40D is an example of a first engaging portion of the protrusion portion 40. The engagement portion 40E is an example of a second engaging portion of the protrusion portion 40.

The two urging portions 50 include a left urging portion 50 and a right urging portion 50. The left urging portion 50 is provided at the substantially center of the outer surface of the left side wall 46 in the upward/downward direction. Further, the right urging portion 50 is provided at the substantially center of the outer surface of the right side wall 46 in the upward/downward direction. Each urging portion 50 includes a contact member 53 that contacts the support frame 12, and includes two compression springs 54 which urge the contact member 53.

The contact member 53 extends in the frontward/rearward direction and has a substantially box shape having an open upper end. The contact member 53 includes a lower wall 53A which extends in the frontward/rearward direction, a front wall 53B which extends upward from the front end portion of the lower wall 53A, a rear wall 53C which extends upward from the rear end portion of the lower wall 53A, an engagement portion 53D which extends forward from the upper end portion of the front wall 53B, and an engagement portion 53E which extends forward from the upper end portion of the rear wall 53C. The lower wall 53A contacts the upper surface of the left/right inner end portion of the side frames 41. The engagement portion 53D has a flat plate shape, and is engageable with the engagement portion 40D of the protrusion portion 40. The engagement portion 53E has a flat plate shape and is engageable with the engagement portion 40E of the protrusion portion 40. The contact member 53 is movable between a compression position (see FIG. 5) and a compression release position. The compression position is a position in which the compression spring 54 is compressed so that the engagement portions 53D and 53E do not engage with the engagement portions 40D and 40E. The compression release position (see FIG. 9) is a position in which the compression of the compression spring 54 is released so that the engagement portions 53D and 53E engage with the engagement portions 40D and 40E. The lower wall 53A is an example of a first wall of the contact member 53. The front wall 53B is an example of a second wall of the contact member 53. The rear wall 53C is an example of a third wall of the contact member 53. The engagement portion 53D is an example of a first engaging portion of the contact member 53. The engagement portion 53E is an example of a second engaging portion of the contact member 53.

The compression spring 54 is a coil spring extending in the upward/downward direction. Two compression springs 54 are disposed so as to be separated from each other in the frontward/rearward direction. The front compression spring 54 of two compression springs 54 is an example of a first compression spring. The rear compression spring 54 of two compression springs 54 is an example of a second compression spring. The upper end of the compression spring 54 contacts the lower surface of the upper wall 40A of the protrusion portion 40. The lower end of the compression spring 54 contacts the upper surface of the lower wall 53A of the contact member 53. Accordingly, the compression springs 54 urge the contact member 53 downward with respect to the protrusion portion 40. In other words, the compression springs 54 urge the protrusion portion 40 upward with respect to the contact member 53. That is, the two compression springs 54 urge both front and rear end portions of the protrusion portion 40.

The photosensitive drum 16 includes, as illustrated in FIGS. 2 and 4A, a drum body 16A and two flange members 16B.

The drum body 16A has a substantially cylindrical shape extending in the leftward/rightward direction (the axial direction). The drum body 16A has a photosensitive layer formed on the surface thereof. That is, the rotation axis A (see FIG. 2) of the photosensitive drum 16 extends in the leftward/rightward direction.

The two flange members 16B have a left flange member 16B and a right flange member 16B. The left flange member 16B is fitted to the left end portion of the drum body 16A so as not to be relatively rotatable, and is rotatably fitted to the drum support portion 49 of the left side wall 46. Further, the right flange member 16B is fitted to the right end portion of the drum body 16A so as not to be relatively rotatable, and is rotatably fitted to the drum support portion 49 of the right side wall 46. The flange member 16B has a substantially columnar shape extending in the leftward/rightward direction. The left flange member 16B includes a coupling concave portion 16C and two protrusions 16D. The coupling concave portion 16C is recessed rightward from the left surface of the left flange member 16B. The coupling concave portion 16C has a substantially circular shape in the side view. Two protrusions 16D are disposed inside the coupling concave portion 16C so as to be separated from each other in the radial direction of the coupling concave portion 16C. The protrusion 16D protrudes inward in the radial direction from the inner peripheral surface of the coupling concave portion 16C and has a substantially rectangular shape in the side view.

(2) Developing Unit

As illustrated in FIGS. 2 and 6, the developing unit 15 includes a developing frame 55 and a developing electrode 56 electrically connected to the developing roller 18 and the supply roller 19.

The developing frame 55 has a substantially box shape extending in the leftward/rightward direction. The developing frame 55 includes therein the toner storage portion 21 (see FIG. 1), and supports the developing roller 18, the supply roller 19, and the toner thickness regulation blade 20. Further, the developing frame 55 includes two swing shafts 55A, which are a right swing shaft 55A and a left swing shaft 55A. The left swing shaft 55A is rotatably supported by the developing support portion 51 of the left side wall 46. Further, the right swing shaft 55A is rotatably supported by the developing support portion 51. In addition, the developing unit 15 is pivotable or swingable about the left swing shaft 55A and the right swing shaft 55A as support points. Specifically, the developing unit 15 is pivotable between a position (see FIG. 1) in which the developing roller 18 contacts the photosensitive drum 16 and a position (not shown) in which the developing roller 18 is separated from the photosensitive drum 16.

As illustrated in FIGS. 4B and 6, the developing electrode 56 is supported by the right end of the developing frame 55 so as to be exposed from the exposure opening 52 of the right side wall 46 when viewed from the right side. The developing electrode 56 has a substantially elongated hole shape extending in the frontward/rearward direction in the side view.

3. Detail of Apparatus Body

As illustrated in FIGS. 1 and 2, the apparatus body 2 further includes an outer frame 61, an inner frame 62, a drive unit 63 which supplies a drive force to the process cartridge 13, a power supply unit 64 which supplies electric power to the process cartridge 13, two guide portions 65 which guide the support frame 12, and two pressing portions 60 which exert a pressing force on the process cartridge 13.

(1) Outer Frame and Inner Frame

The outer frame 61 forms the exterior of the apparatus body 2. The outer frame 61 has a substantially box shape. The outer frame 61 includes the sheet discharging tray 11 described above.

The inner frame 62 is disposed inside the outer frame 61. The inner frame 62 extends in the frontward/rearward direction and has a substantially prismatic shape having a front open end and a rear open end. The inner frame 62 includes two side plates 66, an upper plate 67, a lower plate 68, and two drum positioning plates 69 which position the photosensitive drum 16 with respect to the apparatus body 2.

As illustrated in FIGS. 2 and 6, the two side plates 66 have left and right side plates 66. The left side plate 66 is separately disposed at the right side of the side wall of the left outer frame 61. Further, the right side plate 66 is separately disposed at the left side of the side wall of the right outer frame 61. Each side plate 66 has a substantially flat plate shape extending in the upward/downward direction.

The upper plate 67 is disposed, as illustrated in FIG. 2, at the upper end portion of the inner frame 62. The upper plate 67 has a substantially flat plate shape extending in the leftward/rightward direction. The upper plate 67 is suspended between the upper end portion of the left side plate 66 and the upper end portion of the right side plate 66. The upper plate 67 supports the scanner unit 4.

The lower plate 68 is disposed at the lower end portion of the inner frame 62. The lower plate 68 has a substantially flat plate shape extending in the leftward/rightward direction. The lower plate 68 is disposed above the sheet feeding tray 9 so as to be suspended between the lower end of the left side plate 66 and the lower end of the right side plate 66.

Figure 5:
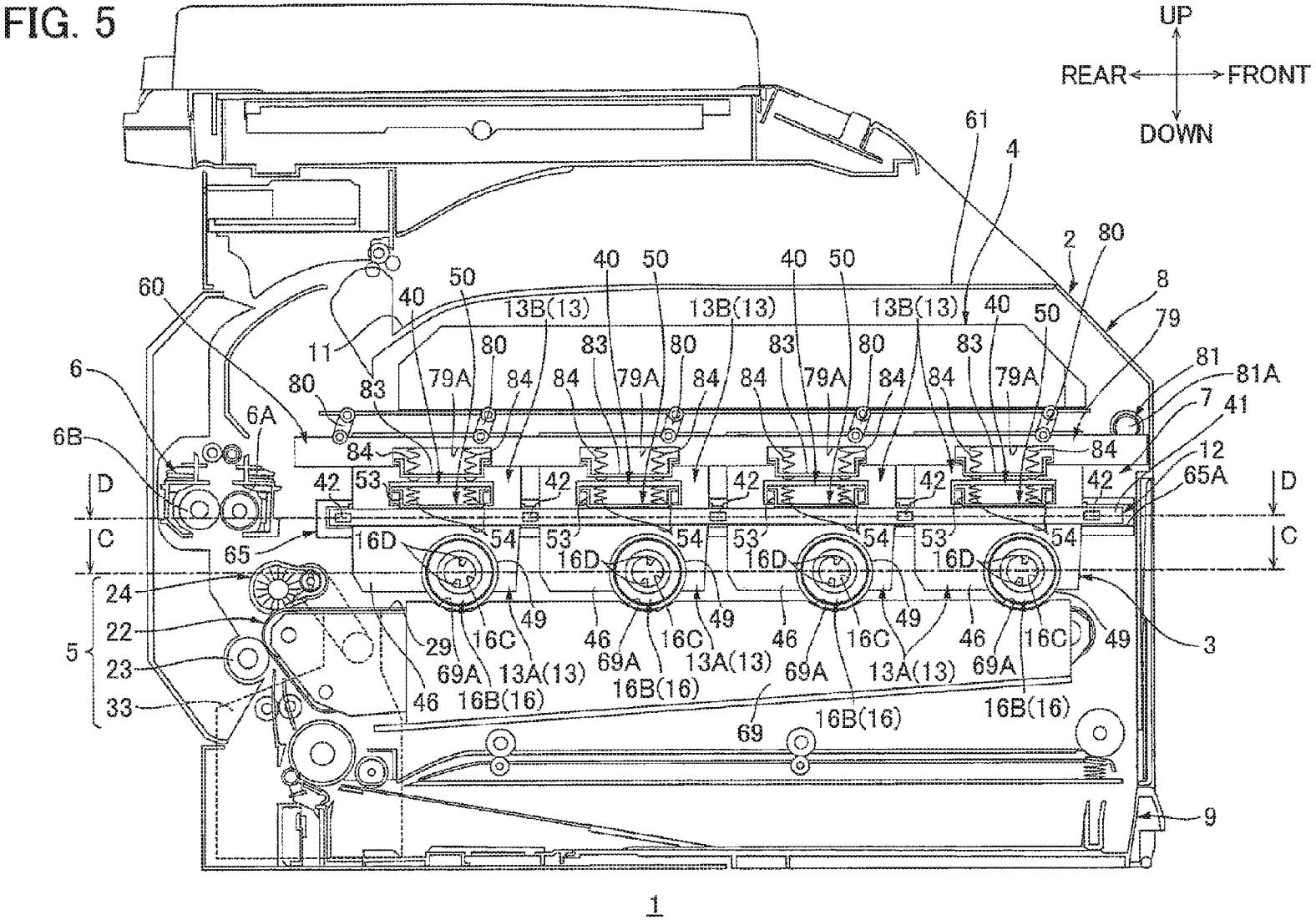
FIG. 5 is a cross-sectional view of the printer taken along a line B-B of FIG. 2.

As illustrated in FIGS. 2 and 5, the two drum positioning plates 69 include left and right side plates 69. The left drum positioning plate 69 is separately disposed at the right side of the left side plate 66 in the lower end portion of the inner frame 62. The right drum positioning plate 69 is separately disposed at the left side of the right side plate 66 in the lower end of the inner frame 62. The drum positioning plate 69 has a substantially flat plate shape extending in the upward/downward direction. The lower ends of the drum positioning plates 69 are connected to the upper surface of the lower plate 68. In addition, the drum positioning plate 69 is an example of a positioning portion. Each drum positioning plate 69 includes four positioning concave portions 69A.

The four positioning concave portions 69A are disposed at the upper end portion of the drum positioning plate 69 so as to be separated from one another at the same interval in the frontward/rearward direction. Each positioning concave portion 69A is recessed downward from the upper edge of the drum positioning plate 69. The positioning concave portion 69A has a substantially U-shape forming an upper open end in the side view. The positioning concave portion 69A receives the drum support portion 49 of the process cartridge 13 so as to position the photosensitive drum 16 in the frontward/rearward direction.

(2) Drive Unit

As illustrated in FIGS. 2 and 6, the drive unit 63 is supported at the substantially center portion of the left side plate 66 in the upward/downward direction. The drive unit 63 includes four drum drive gears 71, four body couplings 70, and a linear motion cam 72. Four drum drive gears 71 are rotated by a drive force transmitted from a motor (not shown).

Figure 8:
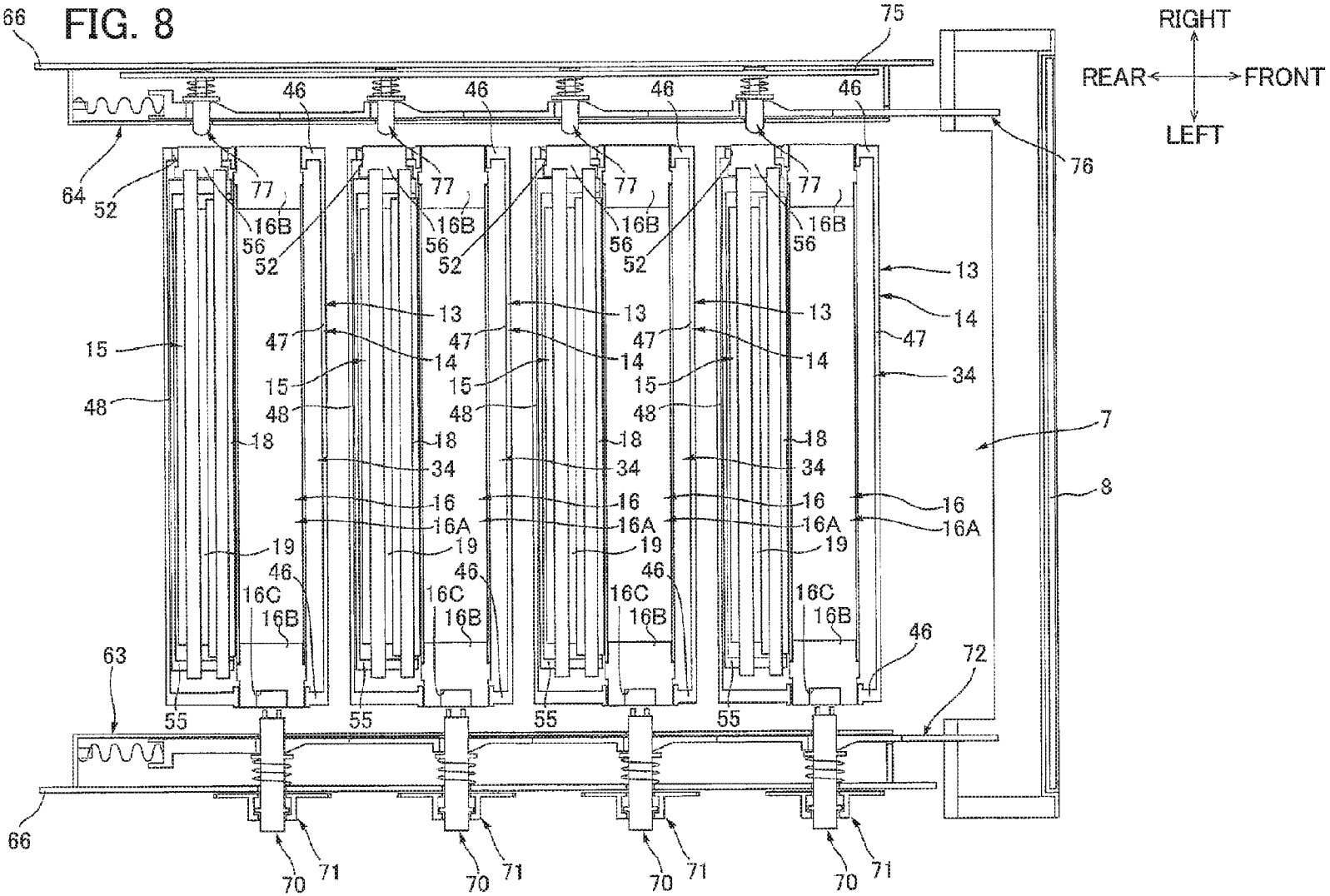
FIG. 8 is a cross-view of the printer taken along a line C-C of FIG. 5, and showing a state where a drive side linear motion cam and a power supply side linear motion cam are at pressing positions whereas body couplings and electrodes are at retracting positions when a front cover is on a way to an opening position from a closing position in the printer according to the embodiment.

The body coupling 70 is movable between an advancing position (see FIGS. 2 and 6) and a retracting position (see FIGS. 8 and 10) in accordance with the movement of the linear motion cam 72 in the frontward/rearward direction. The advancing position is a position in which the body coupling engages with the coupling concave portion 16C of the photosensitive drum 16. The retracting position is a position in which the engagement of the photosensitive drum 16 with respect and the coupling concave portion 16C is released. The photosensitive drum 16 is rotatable by a drive force transmitted from the drum drive gear 71 when the body coupling 70 is located at the advancing position.

(3) Power Supply Unit

The power supply unit 64 is supported at the substantially center portion of the right side plate 66 in the upward/downward direction. The power supply unit 64 includes a power supply substrate 75, a linear motion cam 76, and four body electrodes 77.

The body electrode 77 is movable between an advancing position (see FIGS. 2 and 6) and a retracting position (see FIGS. 8 and 10) in accordance with the movement of the linear motion cam 76 in the frontward/rearward direction. The advancing position is a position in which the body electrode contacts the developing electrode 56. The retracting position is a position in which the contact between the body electrode and the developing electrode 56 is released. The developing electrode 56 is configured to receive electric power from the power supply substrate 75 when the body electrode 77 is located at the advancing position.

(4) Guide Portion

Figure 7:
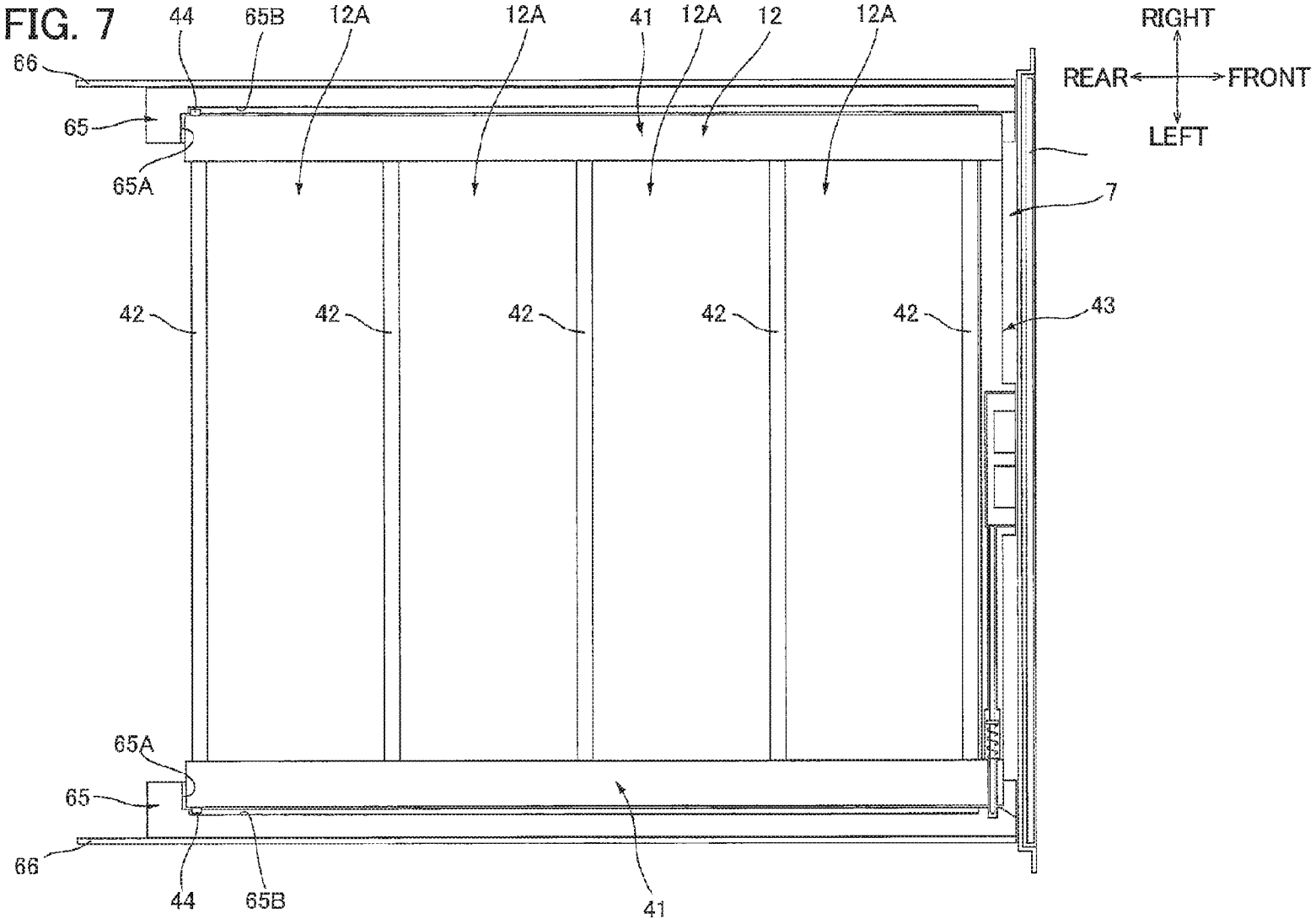
FIG. 7 is a cross-sectional view of the printer taken along a line D-D of FIG. 5, while omitting the process cartridge for better understanding to the process frame.

As illustrated in FIGS. 2 and 7, the two guide positions 65 include a left guide portion 65 and a right guide portion 65. The left guide portion 65 is disposed at the right side of the left side plate 66, and is positioned upward of the drive unit 63. The right guide portion 65 is disposed at the left side of the right side plate 66, and is positioned upward of the power supply unit 64. The guide portion 65 has a substantially prismatic shape extending in the frontward/rearward direction. Each guide portion 65 has a first guide groove 65A, a second guide groove 65B, and two rollers 65D.

The first guide groove 65A is recessed outward in the leftward/rightward direction from the inner surface of the guide portion 65 in the leftward/rightward direction, and extends in the frontward/rearward direction. The first guide groove 65A has a substantially rectangular shape in the cross-sectional view. The first guide groove 65A has a front open end.

The second guide groove 65B is recessed outward in the leftward/rightward direction from the inner surface of the first guide groove 65A in the leftward/rightward direction and extends in the frontward/rearward direction. The second guide groove 65B has a substantially rectangular shape in the cross-sectional view. The front end of the second guide groove 65B is closed.

Figure 10:
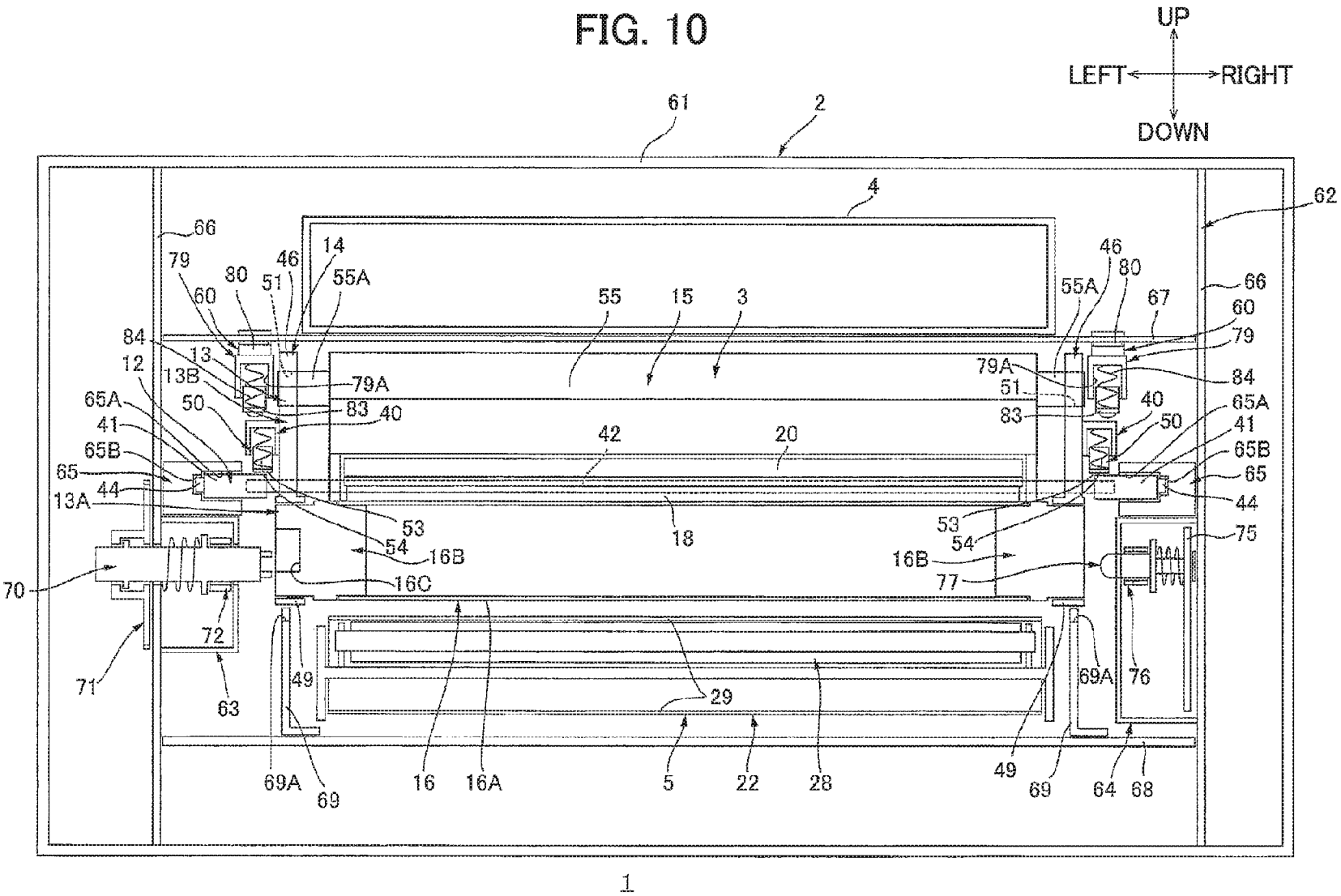
FIG. 10 is a cross-sectional view taken along the line A-A of FIG. 1 and showing the state of FIG. 9.

Two rollers 65D are disposed at the front end portion of the first guide groove 65A so as to be separated from each other in the frontward/rearward direction as illustrated in FIG. 10. Each roller 65D has a substantially disk shape so as to be rotatable about the axis extending in the leftward/rightward direction. The upper end portions of the rollers 65D protrude upward from the lower inner surface of the first guide groove 65A.

(5) Pressing Portion

As illustrated in FIGS. 2 and 5, the pressing portions 60 include a left pressing portion 60 and a right pressing portion 60. The left pressing portion 60 is disposed upward of the left guide portion 65 and is supported by the left end of the upper plate 67. The right pressing portion 60 is disposed upward of the right guide portion 65 and is supported by the right end of the upper plate 67. The pressing portion 60 is movable between a pressing position (see FIG. 2) and a non-pressing position (see FIG. 10). In the pressing position, the pressing portion 60 contacts the protrusion portion 40 of the process cartridge 13 so as to press the protrusion portion 40. In the non-pressing position, the pressing portion is separated from the protrusion portion 40 of the process cartridge 13 so that the pressing against the protrusion portion 40 is released. Each pressing portion 60 includes a pressing bar 79, four link members 80, a rotation member 81, and a tension spring 82 (see FIG. 1).

The pressing bar 79 has a substantially prismatic shape extending in the frontward/rearward direction. The pressing bar 79 includes four storage portions 79A, four pressing members 83, and eight compression springs 84.

Four storage portions 79A are disposed so as to be separated from one another in the frontward/rearward direction. Each storage portion 79A is disposed above the urging portion 50 of the process cartridge 13. The storage portion 79A is a concave portion which is recessed upward from the lower surface of the pressing bar 79 and extends in the frontward/rearward direction. The storage portion 79A has a substantially rectangular shape having a lower open end in the side sectional view.

The pressing member 83 is fitted to the storage portion 79A. The pressing member 83 extends in the frontward/rearward direction and has a substantially box shape having an upper open end.

The compression spring 84 is disposed in the storage portion 79A in a compression state. The compression spring 84 is a coil spring extending in the upward/downward direction. The upper end of the compression spring 84 contacts the inner surface of the storage portion 79A, that is, the lower surface of the upper wall of the storage portion 79A. The lower end of the compression spring 84 contacts the inner surface of the storage portion 79A, that is, the upper surface of the lower wall of the pressing member 83. Accordingly, the compression spring 84 urges the pressing member 83 downward. In addition, the urging force of the compression spring 84 is stronger than the urging force of the compression spring 54 of the urging portion 50 of the process cartridge 13.

Four link members 80 are disposed above the pressing bar 79. The lower end of the link member 80 is rotatably connected to the upper end of the pressing bar 79. The upper end of the link member 80 is rotatably connected to the upper plate 67.

As illustrated in FIG. 1, the rotation member 81 is disposed at the front upper end portion of the apparatus body 2. The rotation member 81 includes a rotation shaft 81A, a first connection portion 81B, and a second connection portion 81C. The rotation shaft 81A has a substantially columnar shape extending in the leftward/rightward direction and is supported by the side plate 66 so as to be rotatable. The first connection portion 81B has a substantially flat plate shape extending backward from the rotation shaft 81A. The second connection portion 81C has a substantially flat plate shape extending downward from the rotation shaft 81A. The second connection portion 81C is rotatably connected to the front end of the pressing bar 79.

The tension spring 82 is a coil spring extending in the upward/downward direction. The upper end of the tension spring 82 is connected to the first connection portion 81B. The lower end portion of the tension spring 82 is connected to the rear surface of the front cover 8. The tension spring 82 extends longer than its natural length in accordance with the movement of the front cover 8 from the closing position to the opening position.

4. Attachment/Detachment Operation of Process Cartridge

Following describes an operation in which the process cartridge 13 is separated from the apparatus body 2 will be described.

Figure 9:
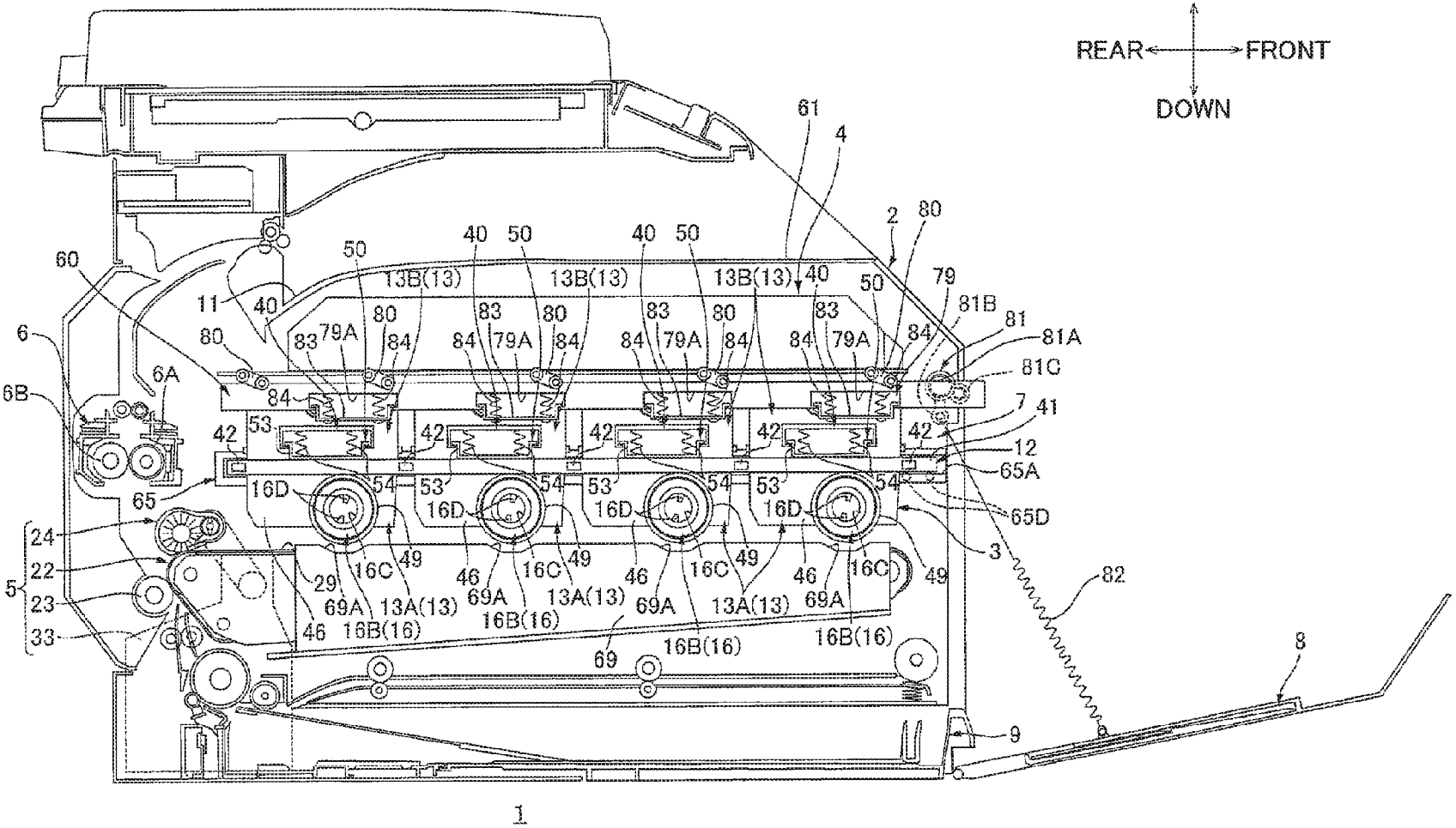
FIG. 9 is a cross-sectional view taken along the line B-B of FIG. 2, and showing a state where the front cover is at the opening position and the process cartridge is at a second position in the printer according to the embodiment.

Referring to FIG. 1, the tension spring 82 connected to the pressing portion 60 in the apparatus body 2 is pulled forward and downward when the front cover 8 moves from the closing position to the opening position. Then, as illustrated in FIG. 9, the rotation member 81 of the pressing portion 60 rotates in the counter-clockwise direction in the left view about the rotation shaft 81A when the first connection portion 81B is pulled forward and downward by the urging force of the tension spring 82. Accordingly, the pressing bar 79 of the pressing portion 60 is pulled forward and upward by the second connection portion 81C so as to move forward and upward while maintaining its horizontal posture as illustrated in FIG. 9. Then, the pressing member 83 is separated from the protrusion portion 40 of the process cartridge 13 forward and upward. Accordingly, the pressing portion 60 is located at the non-pressing position.

Since the contact member 53 of the urging portion 50 of the process cartridge 13 contacts the upper surface of the side frame 41 of the support frame 12, the protrusion portion 40 is urged upward with respect to the contact member 53 due to the urging force of the compression spring 54.

Accordingly, the process cartridge 13 moves upward from the first position to the second position due to the urging force of the urging portion 50. The contact member 53 of the urging portion 50 moves from the compression position to the compression release position in accordance with the movement of the process cartridge 13 from the first position to the second position. In other words, the process cartridge 13 is moved from the first position to the second position by the reaction force against the pressing force on the side frame 41, as the contact member 53 moves from the compression position to the compression release position.

Then, as illustrated in FIG. 10, the drum support portion 49 of the process cartridge 13 is separated from the positioning concave portion 69A in the apparatus body 2. Meanwhile, the photosensitive drums 16 of the process cartridges 13 are separated upward from the intermediate transfer belt 29, and each photosensitive drum 16 maintains a same vertical distance from the transfer belt 29 uniformly in the leftward/rightward direction.

Figure 11:
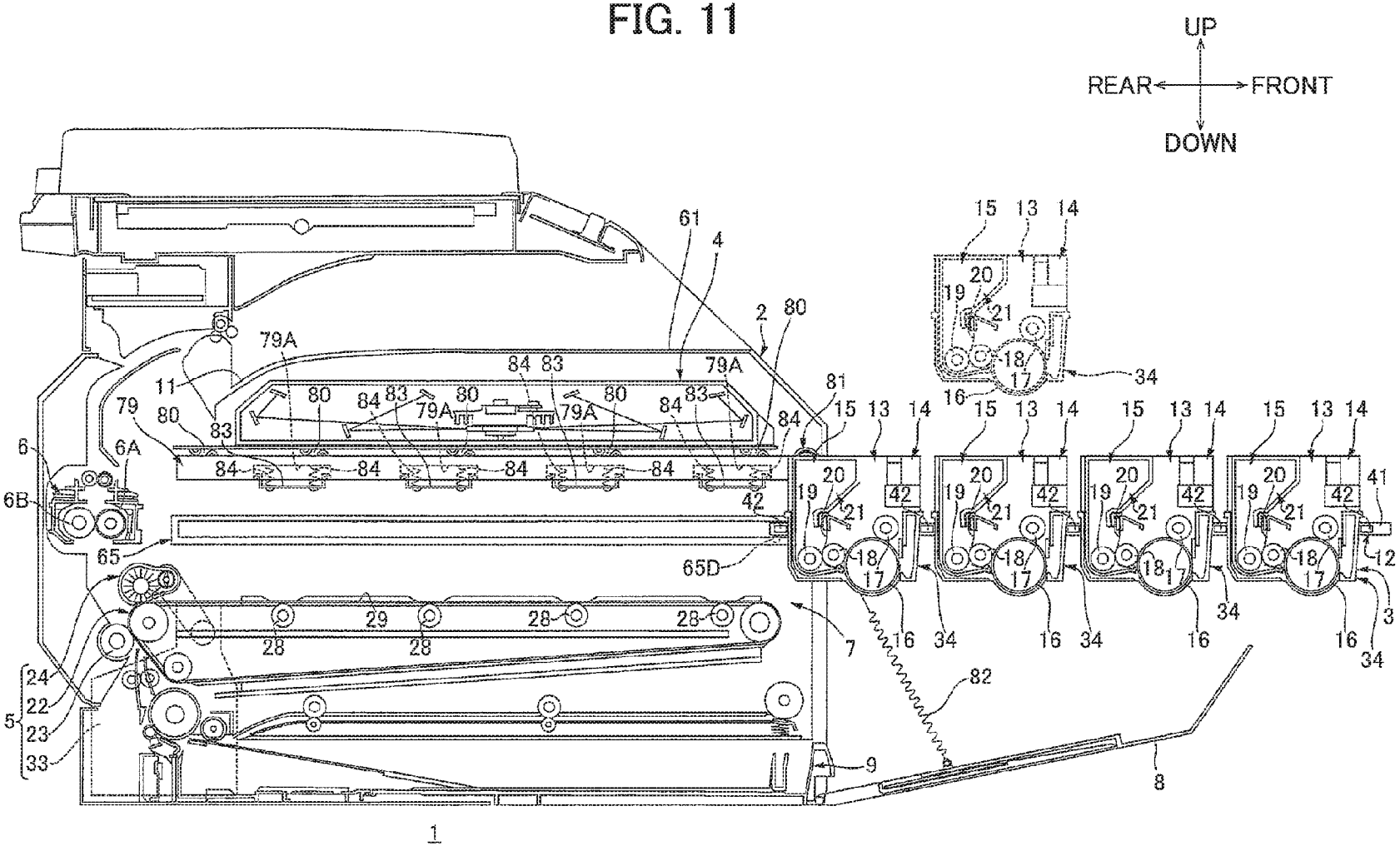
FIG. 11 is a view showing a state where a process unit is pulled out from an apparatus body of the printer according to the embodiment.

Next, as illustrated in FIG. 11, the support frame 12 supporting the process cartridge 13 is drawn forward from the apparatus body 2 so as to move to the outer position.

Subsequently, the process cartridge 13 is pulled upward from the support frame 12 as indicated by the dashed line of FIG. 11.

Accordingly, the detachment of the process cartridge 13 from the apparatus body 2 is completed.

Following describes an operation in which the process cartridge 13 is attached to the apparatus body 2.

The process cartridge 13 is inserted into the opening 12A of the support frame 12 from the upward position. Accordingly, the process cartridge 13 is supported by the support frame 12. Next, as illustrated in FIG. 9, the support frame 12 supporting the process cartridge 13 is pushed and inserted into the apparatus body 2 so as to be moved to the inner position.

Next, the tension spring 82 is restored when the front cover 8 moves from the opening position to the closing position. Then, the rotation member 81 rotates in the clockwise direction in the left view about the rotation shaft 81A due to the urging force of the coil spring (not shown).

Accordingly, the pressing bar 79 is pressed backward and downward by the second connection portion 81C so as to move backward and upward while maintaining its horizontal posture. Then, the pressing member 83 contacts the upper surface of the protrusion portion 40 so as to press the upper surface of the protrusion portion 40 downward. Accordingly, the pressing portion 60 is positioned at the pressing position.

Then, the process cartridge 13 moves from the second position toward the first position against the urging force of the compression spring 54 of the urging portion 50.

Then, as illustrated in FIG. 2, the drum support portion 49 of the process cartridge engages with the positioning concave portion 69A and the photosensitive drum 16 of the process cartridge 13 contacts the upper surface of the intermediate transfer belt 29.

Accordingly, the attachment of the process cartridge 13 to the apparatus body 2 is completed.

6. Operation and Effect (1) According to the printer 1, as illustrated in FIGS. 5 and 9, the process cartridge 13 is provided with the urging portion 50 which urges the support frame 12 and moves the process cartridge 13 so that the engagement between the photosensitive drum 16 and the drum positioning plate 69 is released.

For that reason, the maintenance of the urging portion 50 can be performed simultaneous with the maintenance of the process cartridge 13.

As a result, the maintenance of the urging portion 50 can be c performed and hence the damage of the urging portion 50 can be suppressed.

(2) According to the printer 1, as illustrated in FIG. 2, the urging portion 50 is disposed at the outside of the side wall of the process cartridge 13 in the leftward/rightward direction.

For that reason, the urging portion 50 can easily exert force on the side frame 41 of the support frame 12, so that the pressing portion 60 can apply a force to the urging portion 50.

(3) According to the printer 1, as illustrated in FIG. 10, the vertical distance between the drum positioning plate 69 and the flange member 16B of the photosensitive drum 16 is uniform in the leftward/rightward direction, when the process cartridge 13 is positioned at the second position.

For that reason, the process cartridge 13 can be vertically moved while its horizontal posture is maintained.

Accordingly, the process cartridge 13 can be moved between the first position and the second position while the relative arrangement in the leftward/rightward direction is maintained between the photosensitive drum 16 and the drum positioning plate 69.

As a result, the flange members 16B of the photosensitive drums 16 can reliably engage with the positioning concave portion 69A of the drum positioning plate 69.

(4) According to the printer 1, as illustrated in FIG. 2, the pressing portion 60 is provided so as to press the process cartridge 13 from the second position toward the first position.

For that reason, the process cartridge 13 can be reliably located at the first position while the support frame 12 is located at the inner position.

(5) According to the printer 1, the pressing force of the pressing portion 60 is larger than the urging force of the urging portion 50.

Accordingly, the process cartridge 13 can be reliably located at the first position.

(6) According to the printer 1, as illustrated in FIG. 2, both the pressing portion 60 and the compression springs 54 of the urging portion 50 can exert a force on the protrusion portion 40 of the process cartridge 13.

For that reason, the number of components can be decreased, as compared to a case where the pressing portion 60 and the compression spring 54 of the urging portion 50 apply a force to different portions. Further, since forces are applied to the protrusion portion 40 in the opposite directions, the behavior of the process cartridge 13 can be stabilized. Specifically, the resultant force of the vertical forces can be prevented from being exerted in the rotating direction.

(7) According to the printer 1, as illustrated in FIG. 9, the compression springs 54 of the urging portion 50 urging the protrusion portion 40 are disposed separately in the frontward/rearward direction.

For that reason, the compression springs 54 can stably urge the protrusion portion 40 in the frontward/rearward direction. The process cartridge 13 is prevented from being inclined in the frontward/rearward direction.

(8) According to the printer 1, as illustrated in FIGS. 1 and 11, the support frame 12 moves horizontally between the inner position and the outer position.

For that reason, the support frame 12 can be moved between the inner position and the outer position with a simple configuration.

(9) According to the printer 1, as illustrated in FIG. 2, the first target guide portion 41L and the second target guide portion 41R of the support frame 12 are disposed at the same vertical position in the side view.

Accordingly, the support frame 12 can be reliably supported by the apparatus body 2 in the leftward/rightward direction.

(10) According to the printer 1, as illustrated in FIGS. 4A and 4B, the urging portion 50 includes two compression springs 54 which are disposed in parallel in the frontward/rearward direction.

For that reason, the protrusion portion 40 can be stably urged in the frontward/rearward direction.

7. Modification

While the description has been made in detail with reference to specific embodiment thereof, it would be apparent to those skilled in the art that various changes and modifications may be made therein without departing from the spirit and scope of the above described embodiment.

In the above-described embodiment, both the pressing portion 60 and the compression springs 54 of the urging portion 50 apply a force to the protrusion portion 40 of the process cartridge 13, but the pressing portion 60 and the compression springs 54 of the urging portion 50 may apply forces to different portions of the process cartridge 13. For example, the pressing portion 60 may apply a force to the upper end portion of the side wall 46 as illustrated in FIG. 2. In this case, the upper end portion of the side wall 46 is an example of a target pressing portion.

According to the modification, the compression spring 54 and the pressing portion 60 can separately apply forces to the upper end portion of the side wall 46 and the protrusion portion 40.

Accordingly, flexibility of the arrangement of the compression spring 54 or the pressing portion 60 can be ensured as compared with a case where the compression spring 54 and the pressing portion 60 apply a force to the same portion.

While the description has been made in detail with reference to specific embodiment thereof, it would be apparent to those skilled in the art that various changes and modifications may be made therein without departing from the spirit and scope of the above described embodiment.

What is claimed is:

1. An image forming apparatus comprising:

a main body having a positioning portion;

a process cartridge comprising a photosensitive drum defining a rotation axis extending in an axial direction, and an urging portion; and a supporting frame configured to support the process cartridge and be movable in a sliding direction perpendicular to the axial direction between an inner position inside the main body and an outer position outside the main body, the process cartridge being movable between a first position and a second position in a state where the supporting frame supporting the process cartridge is in the inner position, the photosensitive drum and the positioning portion engaging with each other in the first position, the engagement between the photosensitive drum and the positioning portion being released in the second position, and the urging portion being configured to exert urging force on the process cartridge in the state where the supporting frame supporting the process cartridge is in the inner position, such that the process cartridge is moved to the second position from the first position.

2. The image forming apparatus according to claim 1, wherein the process cartridge has a side wall configured to support the photosensitive drum; and wherein the urging portion is positioned outside of the process cartridge in the axial direction with respect to the side wall.

3. The image forming apparatus according to claim 1, wherein the positioning portion and the photosensitive drum define a distance therebetween in a direction perpendicular to both the sliding direction and the axial direction in a state where the process cartridge is in the second position, the distance being constant in the axial direction.

4. The image forming apparatus according to claim 1, wherein the main body comprises a pressing portion configured to exert pressing force on the process cartridge toward the first position from the second position.

5. The image forming apparatus according to claim 4, wherein the pressing force is greater than the urging force.

6. The image forming apparatus according to claim 4, wherein the process cartridge has a side wall configured to support the photosensitive drum, and a protrusion portion protruding from the side wall in the axial direction;

wherein, in a state where the process cartridge is in the first position, the urging portion is configured to exert the urging force on the protrusion portion in an urging direction; and wherein, in the state where the process cartridge is in the first position, the pressing portion is configured to exert the pressing force on the protrusion portion in a direction opposite to the urging direction.

7. The image forming apparatus according to claim 6, wherein the urging portion has a dimension in the sliding direction, the urging portion being configured to generate the urging force along the dimension in the state where the process cartridge is in the first position.

8. The image forming apparatus according to claim 6, wherein the urging portion comprises a first compression spring, and a contact member configured to contact the supporting frame and the first compression spring, the contact member being movable with respect to the side wall.

9. The image forming apparatus according to claim 8, wherein the urging portion further comprises a second compression spring, the first compression spring and the second compression spring being arrayed in the sliding direction.

10. The image forming apparatus according to claim 8, wherein the contact member comprises:

a first wall extending in the sliding direction and having a first end portion and a second end portion positioned opposite to the first end portion in the sliding direction;

a second wall extending from the first end portion in a perpendicular direction perpendicular to both the sliding direction and the axial direction;

a third wall extending from the second end portion in the perpendicular direction;

a first engaging portion extending from the second wall in an extending direction parallel to the sliding direction and configured to engage with the protrusion portion; and a second engaging portion extending from the third wall in a direction opposite to the extending direction and configured to engage with the protrusion portion.

11. The image forming apparatus according to claim 10, wherein the protrusion portion comprises:

a first protrusion wall extending in the sliding direction and having a first end protrusion portion and a second end protrusion portion disposed opposite to the first end protrusion portion in the sliding direction;

a second protrusion wall extending from the first end protrusion portion in a direction opposite to the perpendicular direction;

a third protrusion wall extending from the second end protrusion portion in a direction opposite to the perpendicular direction;

a first engaging protrusion portion extending from the second protrusion wall in a direction opposite to the extending direction and configured to engage with the first engaging portion; and a second engaging protrusion portion extending from the third protrusion wall in the extending direction and configured to engage with the second engaging portion.

12. The image forming apparatus according to claim 4, wherein the pressing portion comprises a pressing member configured to contact the process cartridge, a spring pressing the pressing member, and an accommodating portion accommodating the spring.

13. The image forming apparatus according to claim 4, wherein the main body comprises a cover movable to open and close an opening of the main body through which the supporting frame passes; and wherein the pressing portion is movable between a press position and a release position in an interlocking relation with the movement of the cover, the pressing portion being configured to exert the pressing force on the process cartridge in the press position and release the pressing force in the release position.

14. The image forming apparatus according to claim 1, wherein the supporting frame is horizontally movable between the inner position and the outer position.

15. The image forming apparatus according to claim 1, wherein the supporting frame comprises a first guided member and a second guided member positioned opposite to the first guided member in the axial direction, the first guided member and the second guided member configured to be guided by the main body in response to a movement of the supporting frame, the first guided member and the second guided member being disposed in a same position in a direction perpendicular to both the axial direction and the sliding direction.

16. The image forming apparatus according to claim 1, wherein the positioning portion has a plate shape.

17. The image forming apparatus according to claim 1, wherein the process cartridge has a drum support portion configured to support the photosensitive drum; and wherein the positioning portion has a concave portion configured to receive the drum support portion.

18. An image forming apparatus comprising:

a main body having a positioning portion;

a process cartridge comprising a photosensitive drum and an urging portion; and a supporting frame configured to support the process cartridge and be movable between an inner position inside the main body and an outer position outside the main body, the process cartridge being movable between a first position and a second position in a state where the supporting frame supporting the process cartridge is in the inner position, the photosensitive drum and the positioning portion engaging with each other in the first position, the engagement between the photosensitive drum and the positioning portion being released in the second position, and the urging portion being configured to exert urging force on the process cartridge in the state where the supporting frame supporting the process cartridge is in the inner position, such that the process cartridge is moved to the second position from the first position.

19. The image forming apparatus according to claim 18, wherein the photosensitive drum defines a rotation axis extending in an axial direction, wherein the process cartridge has a side wall configured to support the photosensitive drum; and wherein the urging portion is positioned outside of the process cartridge in the axial direction with respect to the side wall.

20. The image forming apparatus according to claim 18, wherein the main body comprises a pressing portion configured to exert pressing force on the process cartridge toward the first position from the second position.

21. The image forming apparatus according to claim 20, wherein the pressing force is greater than the urging force.

22. The image forming apparatus according to claim 20, wherein the photosensitive drum defines a rotation axis extending in an axial direction;

wherein the process cartridge has a side wall configured to support the photosensitive drum, and a protrusion portion protruding from the side wall in the axial direction;

wherein, in a state where the process cartridge is in the first position, the urging portion is configured to exert the urging force on the protrusion portion in an urging direction; and wherein, in the state where the process cartridge is in the first position, the pressing portion is configured to exert the pressing force on the protrusion portion in a direction opposite to the urging direction.

23. The image forming apparatus according to claim 20, wherein the main body comprises a cover movable to open and close an opening of the main body through which the supporting frame passes; and wherein the pressing portion is movable between a press position and a release position in an interlocking relation with the movement of the cover, the pressing portion being configured to exert the pressing force on the process cartridge in the press position and release the pressing force in the release position.

24. The image forming apparatus according to claim 18, wherein the supporting frame is horizontally movable between the inner position and the outer position.

* * * * *